US009587579B2

(12) United States Patent
Ulrey et al.

(10) Patent No.: US 9,587,579 B2
(45) Date of Patent: Mar. 7, 2017

(54) CURRENT PULSING CONTROL METHODS FOR LIFT FUEL PUMPS

(71) Applicant: Ford Global Technologies, LLC, Dearborn, MI (US)

(72) Inventors: Joseph Norman Ulrey, Dearborn, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 199 days.

(21) Appl. No.: 14/444,739

(22) Filed: Jul. 28, 2014

(65) Prior Publication Data

US 2016/0025030 A1 Jan. 28, 2016

(51) Int. Cl.
*F02D 41/30* (2006.01)
*F02D 41/38* (2006.01)

(52) U.S. Cl.
CPC ..... *F02D 41/3082* (2013.01); *F02D 41/3854* (2013.01); *F02D 2200/0602* (2013.01); *F02D 2250/02* (2013.01)

(58) Field of Classification Search
CPC .. F02D 41/30; F02D 41/3082; F02D 41/3094; F02D 41/38; F02D 41/3854; F02D 41/389; F02D 2200/0602; F02D 2250/02
USPC ..... 123/294, 445, 449, 495, 497, 505, 516
See application file for complete search history.

(56) References Cited

U.S. PATENT DOCUMENTS

| | | | | |
|---|---|---|---|---|
| 7,406,955 | B1 * | 8/2008 | Gachik | F02D 19/12 123/1 A |
| 7,640,916 | B2 | 1/2010 | Ulrey et al. | |
| 8,061,329 | B2 | 11/2011 | Pursifull et al. | |
| 2008/0072880 | A1 * | 3/2008 | Wachtendorf | F02D 41/2464 123/495 |
| 2009/0090331 | A1 | 4/2009 | Pursifull | |
| 2009/0095259 | A1 * | 4/2009 | Pursifull | F02D 41/065 123/457 |
| 2009/0188472 | A1 * | 7/2009 | Ulrey | F02D 33/003 123/495 |
| 2011/0023833 | A1 * | 2/2011 | Chamarthi | F02D 41/3845 123/464 |

(Continued)

OTHER PUBLICATIONS

Surnilla, Gopichandra et al., "Robust Direct Injection Fuel Pump System," U.S. Appl. No. 14/155,250, filed Jan. 14, 2014, 61 pages.

(Continued)

*Primary Examiner* — John Kwon
*Assistant Examiner* — Johnny H Hoang
(74) *Attorney, Agent, or Firm* — Julia Voutyras; John D. Russell; B. Anna McCoy

(57) ABSTRACT

Methods are provided for controlling a lift fuel pump configured to provide pressurized fuel to a direct injection fuel pump that further pressurizes the fuel to be sent to a plurality of direct injectors. Control strategies are needed that provide reliable and robust operation of the lift fuel pump by selectively providing current to the pump while optimizing energy consumption. To maintain a desired range of lift fuel pump operation, methods are proposed that involve sending current pulses to the lift fuel pump and switching to continuous current when fuel vapor is detected at an inlet of the direct injection fuel pump.

20 Claims, 8 Drawing Sheets

(56) References Cited

U.S. PATENT DOCUMENTS

2012/0186560 A1* 7/2012 Lund ..... F02D 19/0642
123/495

OTHER PUBLICATIONS

Pursifull, Ross D., "System and Method for Operating an Engine Combusting Liquefied Petroleum Gas," U.S. Appl. No. 13/970,519, filed Aug. 19, 2013, 30 pages.
Pursifull, Ross D. et al., "High Pressure Fuel Pump Control for Idle Tick Reduction," U.S. Appl. No. 14/042,971, filed Oct. 1, 2013, 34 pages.
Pursifull, Ross D., "Method and System for Supplying Liquefied Petroleum Gas to a Direct Fuel Injected Engine," U.S. Appl. No. 14/532,756, filed Nov. 4, 2014, 39 pages.
Ulrey, Joseph N. et al., "Optimizing Intermittent Fuel Pump Control," U.S. Appl. No. 14/558,363, filed Dec. 2, 2014, 44 pages.
Pursifull, Ross D., "Direct Injection Pump Control," U.S. Appl. No. 14/560,497, filed Dec. 4, 2014, 49 pages.

* cited by examiner

CURRENT PULSING CONTROL METHODS FOR LIFT FUEL PUMPS

FIELD

The present application relates generally to control schemes for a lift fuel pump of an internal combustion engine that involve intermittently providing pulses of current to the lift fuel pump based on a number of preset parameters.

SUMMARY/BACKGROUND

Some vehicle engine systems utilizing direct in-cylinder injection of fuel include a fuel delivery system that has multiple fuel pumps for providing suitable fuel pressure to fuel injectors. This type of fuel system, Gasoline Direct Injection (GDI), is used to increase the power efficiency and range over which the fuel can be delivered to the cylinder. GDI fuel injectors may require high pressure fuel for injection to create enhanced atomization for more efficient combustion. As one example, a GDI system can utilize an electrically driven lower pressure pump (i.e., a fuel lift pump) and a mechanically driven higher pressure pump (i.e., a direct injection pump) arranged respectively in series between the fuel tank and the fuel injectors along a fuel passage. In many GDI applications the lift fuel pump initially pressurizes fuel from the fuel tank to a fuel passage coupling the lift fuel pump and direct injection fuel pump, and the high-pressure or direct injection fuel pump may be used to further increase the pressure of fuel delivered to the fuel injectors. Various control strategies exist for operating the higher and lower pressure pumps to ensure efficient fuel system and engine operation.

In one approach to control the lift fuel pump, shown by Ulrey and Pursifull in U.S. Pat. No. 7,640,916, voltage (and current) provided to the lift fuel pump can be continuous or pulsed based on a number of parameters. The parameters include a volume of fuel in an accumulator located between the lift and direct injection fuel pumps, engine speed and load, and an amount of fuel supplied to the engine. In one example control scheme, when the efficiency of the direct injection fuel pump decrease below an efficiency (or effectiveness) threshold, the lift fuel pump is energized. In this example, the lift pump energy input may cease when the lift pump pressure rises and pressurizes the accumulator located downstream from the lift pump. In another embodiment, the lift pump efficiency is used to determine when activation of the lift pump occurs. If the lift pump efficiency decreases, then fuel vapor may be forming at the pump inlet such that lift pump pressure needs to be increased to increase efficiency of the injector pump.

However, the inventors herein have identified potential issues with the approach of U.S. Pat. No. 7,640,916. First, energizing the lift pump with a pulse of voltage (and current) until a threshold pressure is reached or the lift pump pressure rises may not be the most energy efficient control scheme on which to base pump pulsing. As explained in further detail later, energizing the lift fuel pump for a predetermined time period may be more beneficial to energy-efficient pump operation. Furthermore, the lift pump control scheme depends on sensors such as a pressure sensor to determine when to cease applying voltage to the lift pump (resulting in a voltage pulse of variable duration). As such, continuous and relatively accurate feedback may be needed to ensure reliable operation of the lift fuel pump. Control schemes that do not need feedback (i.e., open loop control) may be more beneficial for more robust pump operation for certain fuel systems.

Thus in one example, the above issues may be at least partially addressed by a method, comprising: operating a lift fuel pump in a pulsed energy mode for a discrete time duration only upon detection of a threshold fuel volume expelled by a direct injection fuel pump positioned downstream of the lift fuel pump; and switching operation of the lift fuel pump to a continuous energy mode when vapor pressure is detected at an inlet of the direct injection fuel pump. In this way, by operating in the pulsed energy mode, energy may be conserved compared to operating entirely in the continuous energy mode. Furthermore, by switching between the two energy modes, robust operation of the lift fuel pump may be provided wherein the continuous mode is activated when vapor is detected, thereby allowing the pump to operate and mitigate the presence of fuel vapor.

In some embodiments, the algorithm for controlling the lift fuel pump may be alternatively implemented by detecting a threshold volume of fuel injected instead of a threshold volume fuel pumped through the direct injection fuel pump. Furthermore, to continuously operate the lift fuel pump until vapor is no longer detected, alternatively this can be implemented by applying a predetermined pulse duration upon detection of vapor and continuously repeating the pulse as long as vapor is detected. As such, this method may include operating the lift fuel pump predominantly via an open loop pulsing scheme, thereby enabling a minimum lift pump energy control scheme that may be backed up with an algorithm that applies lift pump energy if vaporization at the DI pump inlet is detected.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
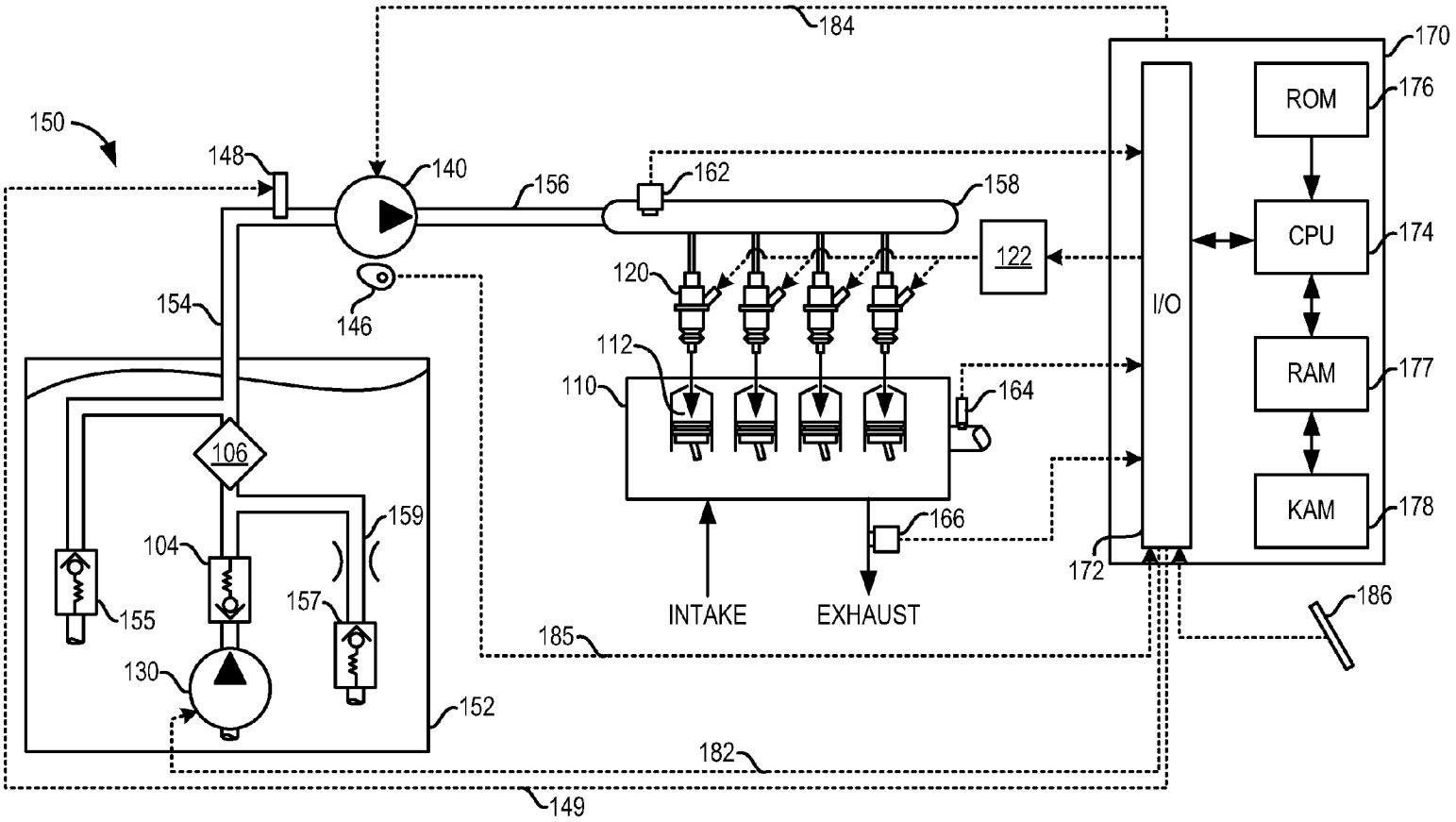
FIG. 1 shows a schematic diagram of an example fuel system coupled to an engine.
Figure 2:
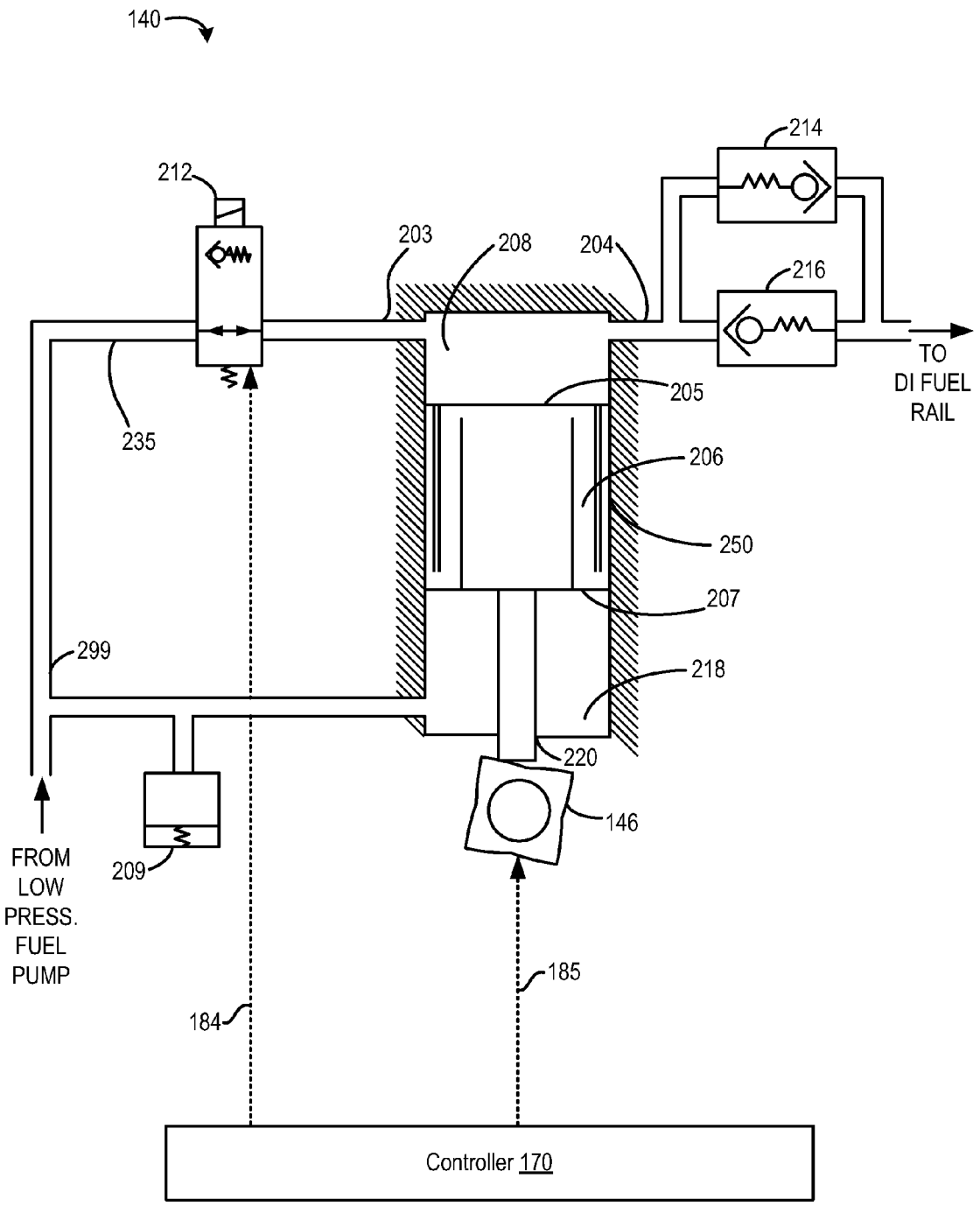
FIG. 2 shows a direct injection fuel pump and related components included in the fuel system of FIG. 1.
Figure 3:
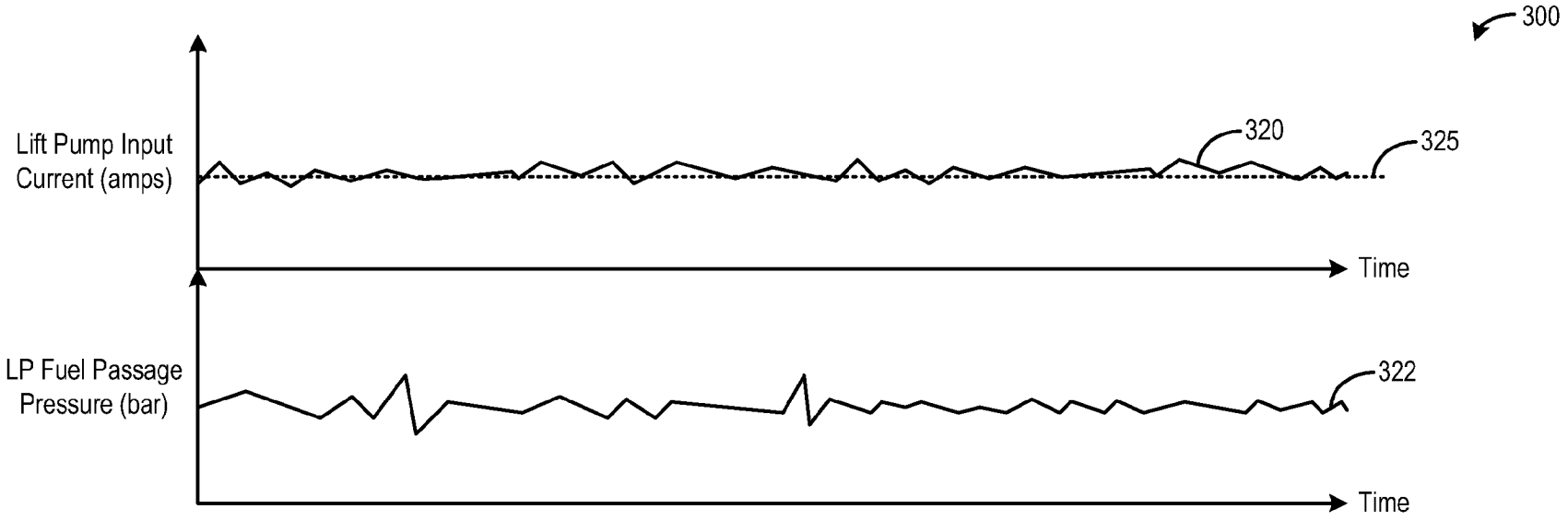
FIG. 3 shows a graphical comparison between different operation modes of a lift fuel pump.
Figure 4:
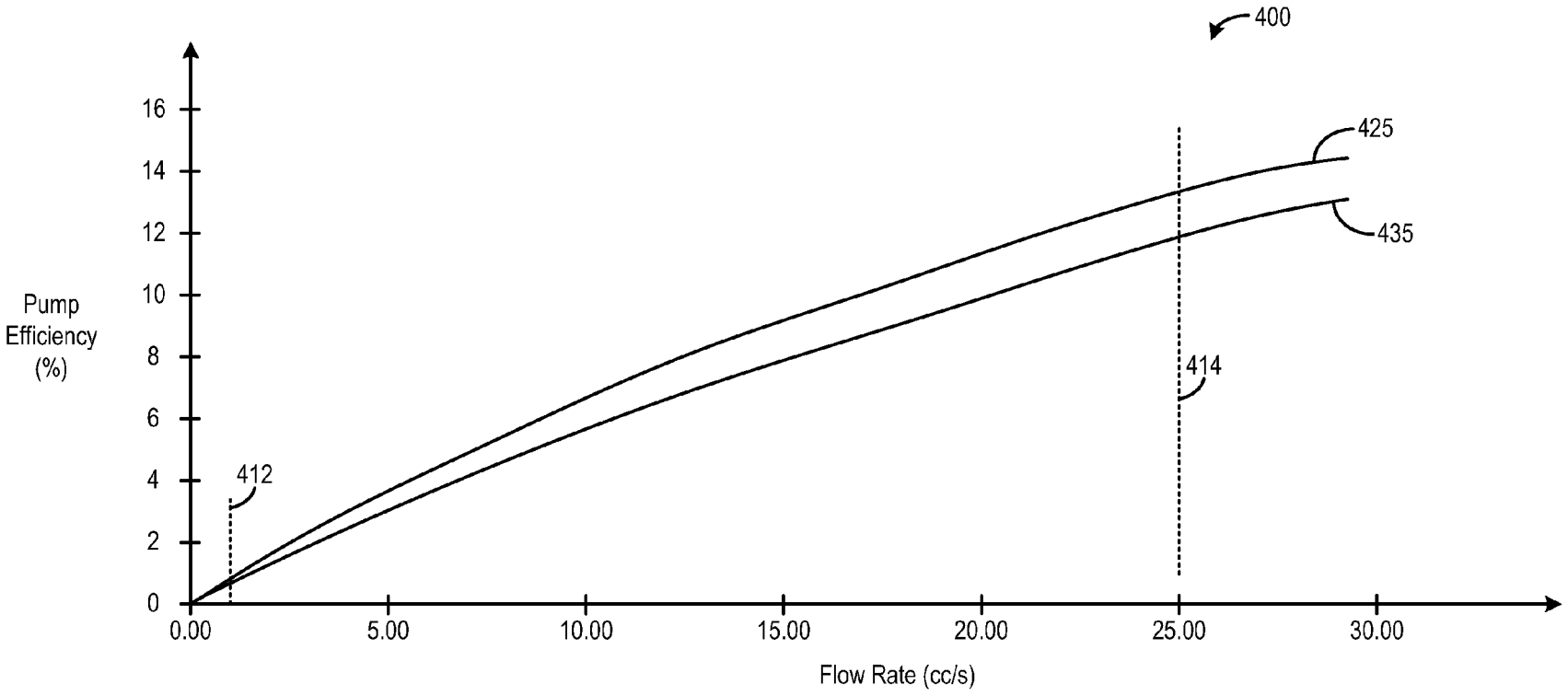
FIG. 4 shows how efficiency of the lift fuel pump changes as flow rate through the pump increases for different pressures.
Figure 5:
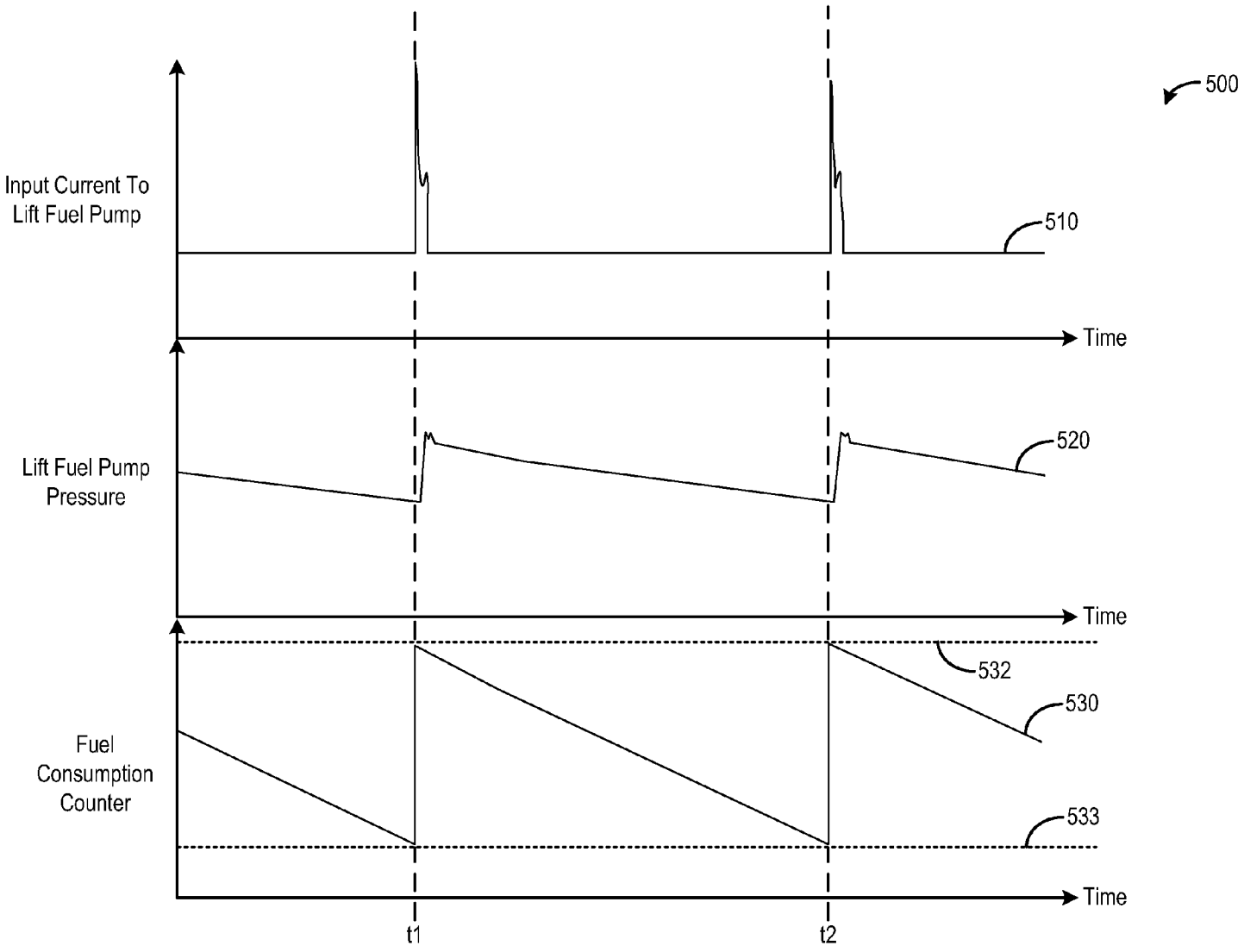
FIG. 5 shows an example pulsed energy mode for a lift fuel pump.
Figure 6:
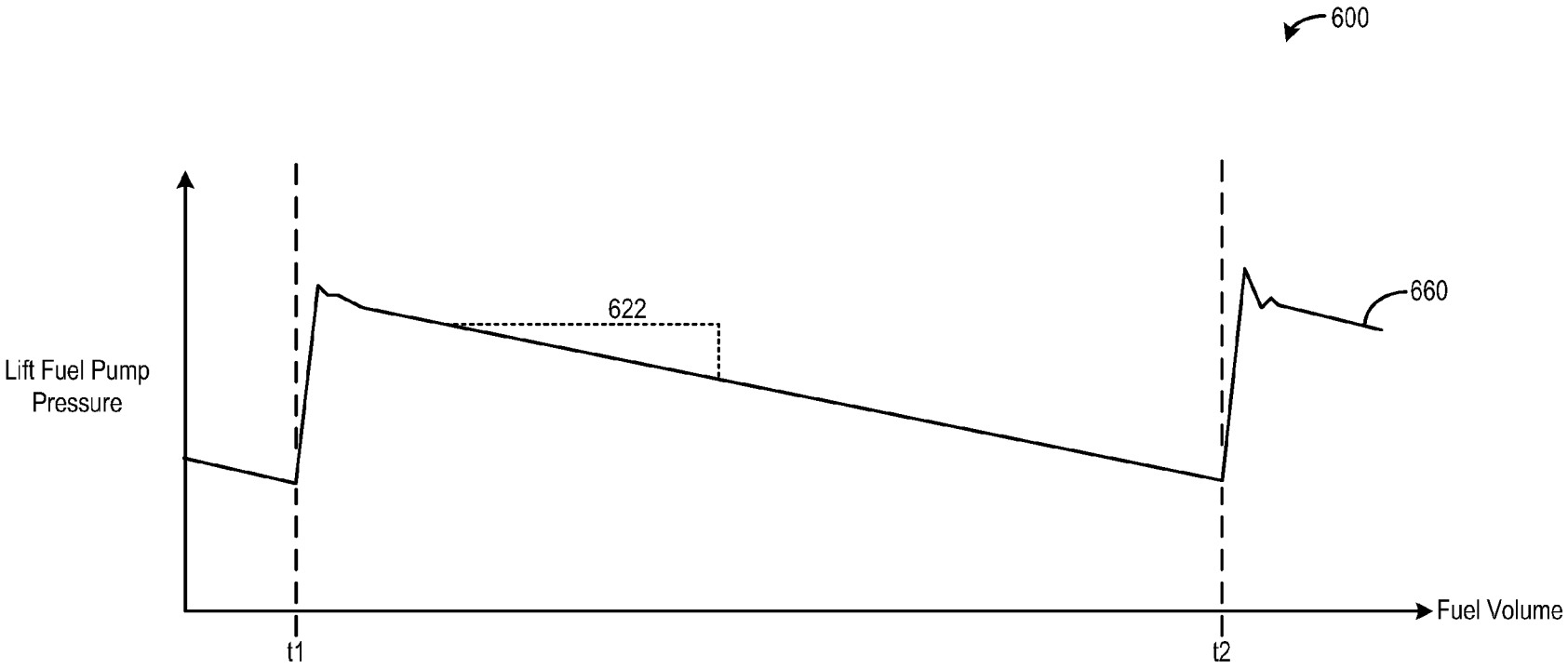
FIG. 6 shows another example pulsed energy mode for a lift fuel pump.
Figure 7:
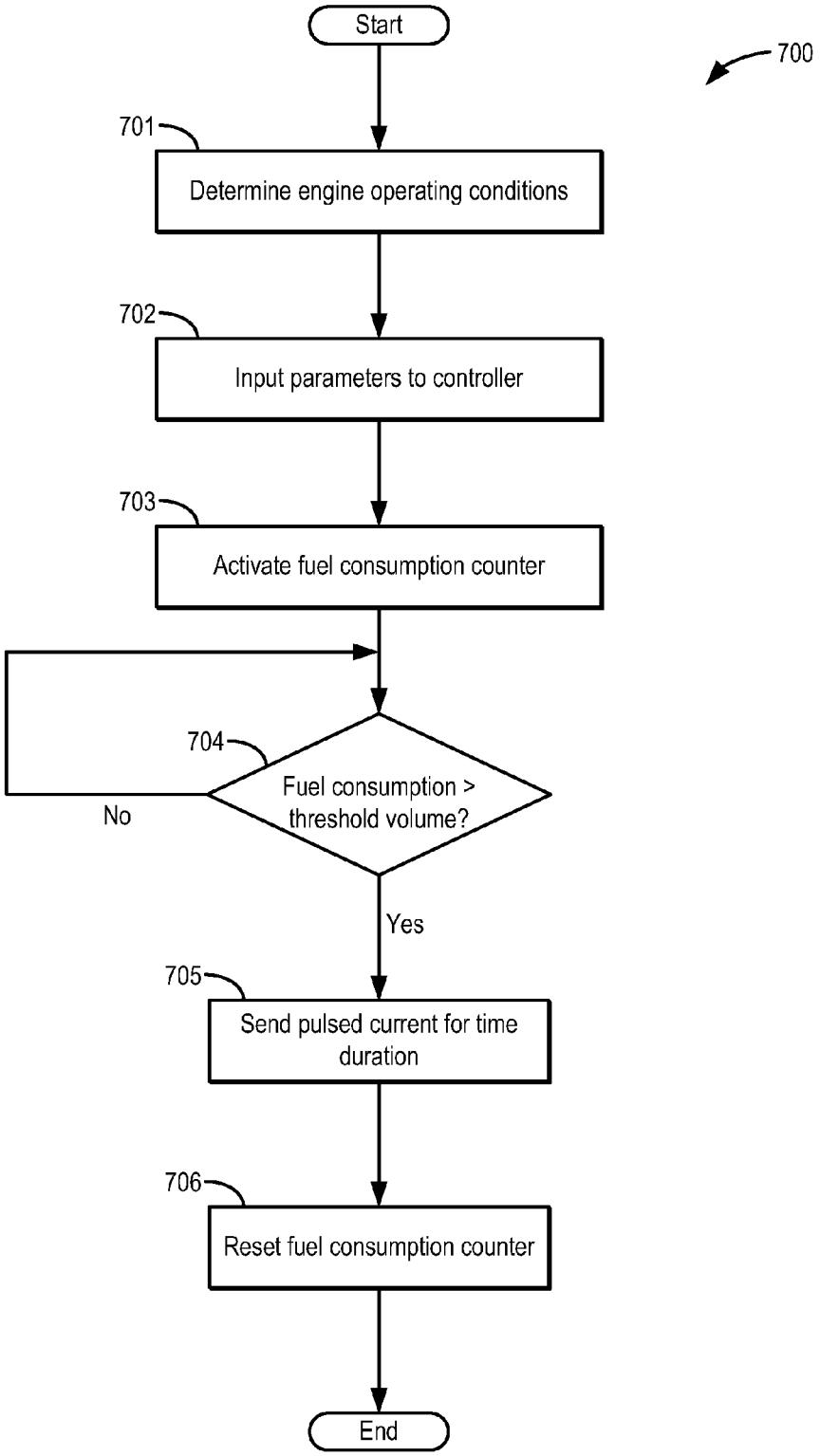
FIG. 7 shows a flow chart of a method for operating the lift fuel pump according to a pulsed energy mode.
Figure 8:
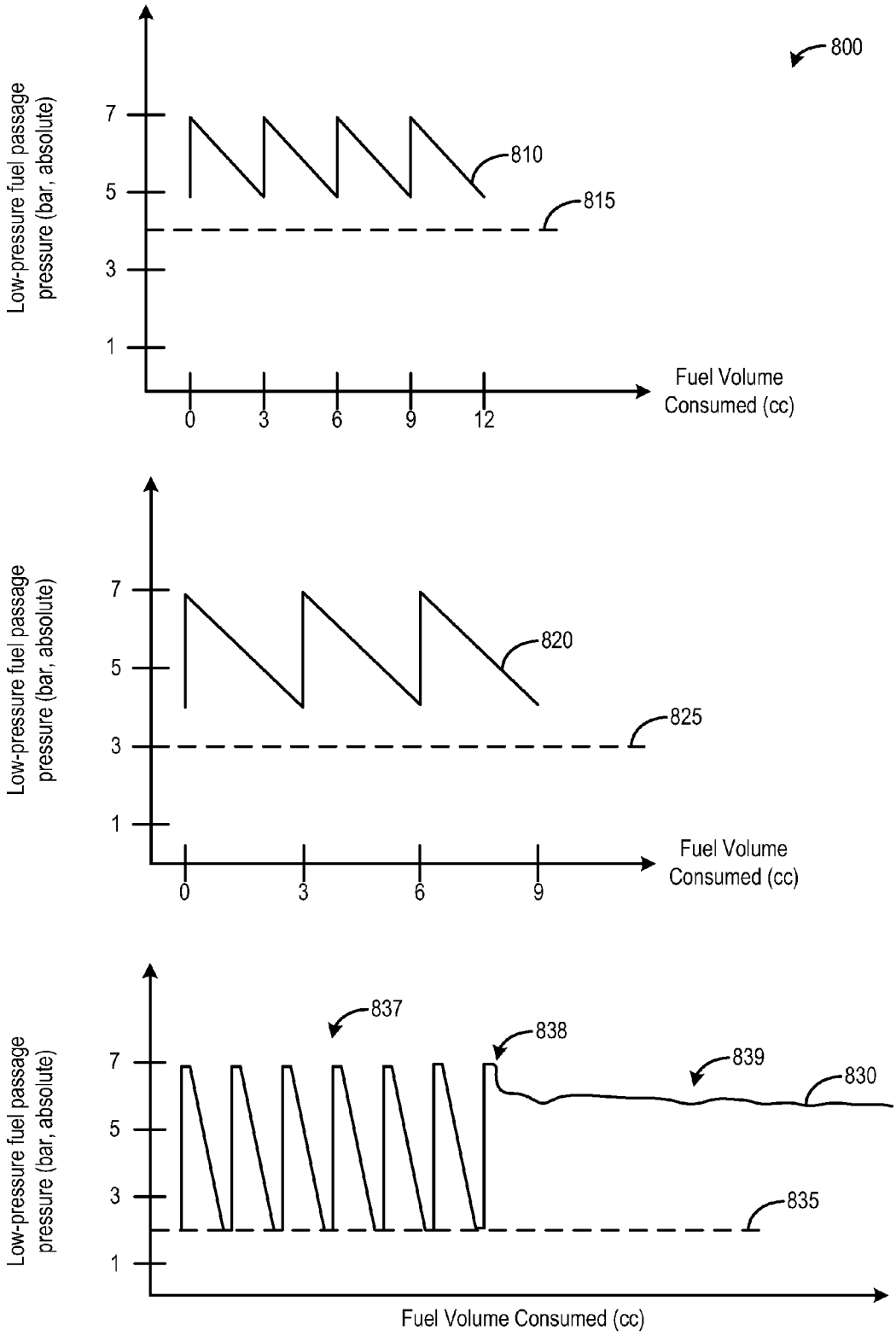
FIG. 8 shows several graphs depicting operation of the lift fuel pump during different situations.

The following detailed description provides information regarding a lift fuel pump, its related fuel and engine systems, and several control strategies for energizing the lift fuel pump to pressurize fuel through the fuel system. A simplified schematic diagram of an example direct injection fuel system and engine is shown in FIG. 1 while FIG. 2 shows a detailed view of a direct injection fuel pump of FIG. 1 and associated components. FIG. 3 shows a graphical comparison between two different control schemes for inputting current to the lift fuel pump. FIG. 4 shows how efficiency of the lift fuel pump changes as fuel flow rate through the pump also changes. FIG. 5 graphically illustrates a method for operating the lift fuel pump according to a pulsed energy mode while FIG. 6 shows another embodiment of the pulsed energy mode. FIG. 7 shows a flow chart illustrating a method to operate the lift fuel pump according to a pulsed energy mode. Lastly, FIG. 8 shows several graphs of example operation of the lift fuel pump.

Regarding terminology used throughout this detailed description, a higher-pressure fuel pump, or direct injection fuel pump, that provides pressurized fuel to a direct injection fuel rail attached injectors may be abbreviated as a DI or HP pump. Similarly, a lower-pressure pump (compressing fuel at pressures generally lower than that of the DI pump), or lift fuel pump, that provides pressurized fuel from a fuel tank to the DI pump may be abbreviated as an LP pump. A solenoid spill valve, which may be electronically energized to allow check valve operation and de-energized to open (or vice versa), may also be referred to as a fuel volume regulator, magnetic solenoid valve, and a digital inlet valve, among other names.

FIG. 1 shows a direct injection fuel system 150 coupled to an internal combustion engine 110, which may be configured as part of a propulsion system for a vehicle. The internal combustion engine 110 may comprise multiple combustion chambers or cylinders 112. Fuel can be provided directly to the cylinders 112 via in-cylinder direct injectors 120. As indicated schematically by arrows in FIG. 1, the engine 110 can also receive intake air and exhaust products of the combusted fuel. For simplicity, the intake and exhaust systems are not shown in FIG. 1. The engine 110 may include a suitable type of engine including a gasoline or diesel engine. In other embodiments, the combusted fuel may include other individual fuels or a combination of different fuels.

Fuel can be provided to the engine 110 via the injectors 120 by way of the direct injection fuel system indicated generally at 150. In this particular example, the fuel system 150 includes a fuel storage tank 152 for storing the fuel on-board the vehicle, a low-pressure fuel pump 130 (e.g., a fuel lift pump), a high-pressure fuel pump or direct injection (DI) pump 140, a fuel rail 158, and various fuel passages 154 and 156. In the example shown in FIG. 1, the fuel passage 154 carries fuel from the low-pressure pump 130 to the DI pump 140, and the fuel passage 156 carries fuel from the DI pump 140 to the fuel rail 158. Due to the locations of the fuel passages, passage 154 may be referred to as a low-pressure fuel passage while passage 156 may be referred to as a high-pressure fuel passage. As such, fuel in passage 156 may exhibit a higher pressure than fuel in passage 154. In some examples, fuel system 150 may include more than one fuel storage tank and additional passages, valves, and other devices for providing additional functionality to direct injection fuel system 150.

In the present example of FIG. 1, fuel rail 158 may distribute fuel to each of a plurality of direct fuel injectors 120. Each of the plurality of fuel injectors 120 may be positioned in a corresponding cylinder 112 of engine 110 such that during operation of fuel injectors 120 fuel is injected directly into each corresponding cylinder 112. Alternatively (or in addition), engine 110 may include fuel injectors positioned at or near the intake port of each cylinder such that during operation of the fuel injectors, fuel is injected with the charge air into the one or more intake ports of each cylinder. This configuration of injectors may be part of a port fuel injection system, which may be included in fuel system 150. In the illustrated embodiment, engine 110 includes four cylinders that are only fueled via direct injection. However, it will be appreciated that the engine may include a different number of cylinders along with a combination of both port and direction fuel injection.

The low-pressure fuel pump 130 can be operated by a controller 170 to provide fuel to DI pump 140 via fuel low-pressure passage 154. The low-pressure fuel pump 130 can be configured as what may be referred to as a fuel lift pump. As one example, low-pressure fuel pump 130 can include an electric pump motor, whereby the pressure increase across the pump and/or the volumetric flow rate through the pump may be controlled by varying the electrical power provided to the pump motor, thereby increasing or decreasing the motor speed. For example, as the controller 170 reduces the electrical power that is provided to LP pump 130, the volumetric flow rate and/or pressure increase across the pump may be reduced. Alternatively, the volumetric flow rate and/or pressure increase across the pump may be increased by increasing the electrical power that is provided to the pump 130. As one example, the electrical power supplied to the low-pressure pump motor can be obtained from an alternator or other energy storage device on-board the vehicle (not shown), whereby the control system provided by controller 170 can control the electrical load that is used to power the low-pressure pump. Thus, by varying the voltage and/or current provided to the low-pressure fuel pump 130, as indicated at 182, the flow rate and pressure of the fuel provided to DI pump 140 and ultimately to the fuel rail 158 may be adjusted by the controller 170. The operation of the low-pressure fuel pump 130 will be discussed in further detail below with reference to FIGS. 3-8.

Low-pressure fuel pump 130 may be fluidly coupled to check valve 104 which may facilitate fuel delivery and maintain fuel line pressure. Filter 106 may be fluidly coupled to outlet check valve 104 via low-pressure passage 154. Filter 106 may remove small impurities that may be contained in the fuel that could potentially damage fuel handling components. With check valve 104 upstream of the filter 106, the compliance of low-pressure passage 154 may be increased since the filter may be physically large in volume. Furthermore, pressure relief valve valve 155 includes a ball and spring mechanism that seats and seals at a specified pressure differential to relieve fuel to limit the fuel pressure at 154. An orifice check valve 157 may be placed in series with an orifice 159 to allow for air and/or fuel vapor to bleed out of the lift pump 130. As seen in FIG. 1, check valve 104 is oriented such that fuel backflow from DI pump 140 to the low-pressure pump 130 is substantially reduced (i.e., eliminated). In some embodiments, fuel system 150 may include a series of check valves fluidly coupled to low-pressure fuel pump 130 to further impede fuel from leaking back upstream of the valves. In this context, upstream flow refers to fuel flow traveling from fuel rail 158 towards low-pressure pump 130 while downstream flow refers to the nominal fuel flow direction from the low-pressure pump towards the fuel rail.

Next, fuel may be delivered from check valve 104 to high-pressure fuel pump (e.g., DI pump) 140. DI pump 140 may increase the pressure of fuel received from the check valve 104 from a first pressure level generated by low-pressure fuel pump 130 to a second pressure level higher than the first level. DI pump 140 may deliver high pressure fuel to fuel rail 158 via high-pressure fuel line 156. Operation of DI pump 140 may be adjusted based on operating conditions of the vehicle in order to provide more efficient fuel system and engine operation. The components of the high-pressure DI pump 140 will be discussed in further detail below with reference to FIG. 2.

The DI pump 140 can be controlled by the controller 170 to provide fuel to the fuel rail 158 via the high-pressure fuel passage 156. As one non-limiting example, DI pump 140 may utilize a flow control valve, a solenoid actuated "spill valve" (SV), or fuel volume regulator (FVR) to enable the control system to vary the effective pump volume of each pump stroke. The spill valve, described in more detail in FIG. 2, may be separate or part of (i.e., integrally formed with) DI pump 140. The DI pump 140 may be mechanically driven by the engine 110 in contrast to the motor driven low-pressure fuel pump or fuel lift pump 130. A pump piston of the DI pump 140 can receive a mechanical input from the engine crank shaft or cam shaft via a cam 146. In this manner, DI pump 140 can be operated according to the principle of a cam-driven, single-cylinder pump. Furthermore, the angular position of cam 146 may be estimated (i.e., determined) by a sensor located near cam 146 communicating with controller 170 via connection 185. In particular, the sensor may measure an angle of cam 146 measured in degrees ranging from 0 to 360 degrees according to the circular motion of cam 146. While cam 146 is shown outside of DI pump 140 in FIG. 1, it is understood that cam 146 may be included in the system of DI pump 140.

As depicted in FIG. 1, a fuel sensor 148 is disposed downstream of the fuel lift pump 130. The fuel sensor 148 may measure fuel composition and may operate based on fuel capacitance, or the number of moles of a dielectric fluid within its sensing volume. For example, an amount of ethanol (e.g., liquid ethanol) in the fuel may be determined (e.g., when a fuel alcohol blend is utilized) based on the capacitance of the fuel. The fuel sensor 148 may be connected to controller 170 via connection 149 and used to determine a level of vaporization of the fuel, as fuel vapor has a smaller number of moles within the sensing volume than liquid fuel. As such, fuel vaporization may be indicated when the fuel capacitance drops off. In some operating schemes, the fuel sensor 148 may be utilized to determine the level of fuel vaporization of the fuel such that the controller 170 may adjust the lift pump pressure in order to reduce fuel vaporization within the fuel lift pump 130. Although not shown in FIG. 1, a fuel pressure sensor may be located in low-pressure passage 154 between the lift pump 130 and the DI pump 140. In that location, the sensor may be referred to as the lift pump pressure sensor or the low-pressure sensor.

Further, in some examples, the DI pump 140 may be operated as the fuel sensor 148 to determine the level of fuel vaporization. For example, a piston-cylinder assembly of the DI pump 140 forms a fluid-filled capacitor. As such, the piston-cylinder assembly allows the DI pump 140 to be the capacitive element in the fuel composition sensor. In some examples, the piston-cylinder assembly of the DI pump 140 may be the hottest point in the system, such that fuel vapor forms there first. In such an example, the DI pump 140 may be utilized as the sensor for detecting fuel vaporization, as fuel vaporization may occur at the piston-cylinder assembly before it occurs anywhere else in the system. Other fuel sensor configurations may be possible while pertaining to the scope of the present disclosure.

As shown in FIG. 1, the fuel rail 158 includes a fuel rail pressure sensor 162 for providing an indication of fuel rail pressure to the controller 170. An engine speed sensor 164 can be used to provide an indication of engine speed to the controller 170. The indication of engine speed can be used to identify the speed of DI pump 140, since the pump 140 is mechanically driven by the engine 110, for example, via the crankshaft or camshaft. An exhaust gas sensor 166 can be used to provide an indication of exhaust gas composition to the controller 170. As one example, the gas sensor 166 may include a universal exhaust gas sensor (UEGO). The exhaust gas sensor 166 can be used as feedback by the controller 170 to adjust the amount of fuel that is delivered to the engine 110 via the injectors 120. In this way, the controller 170 can control the air/fuel ratio delivered to the engine to a prescribed set-point.

Furthermore, controller 170 may receive other engine/exhaust parameter signals from other engine sensors such as engine coolant temperature, engine speed, throttle position, absolute manifold pressure, emission control device temperature, etc. Further still, controller 170 may provide feedback control based on signals received from fuel sensor 148, pressure sensor 162, and engine speed sensor 164, among others. For example, controller 170 may send signals to adjust a current level, current ramp rate, pulse width of a solenoid valve (SV) of DI pump 140, and the like via connection 184 to adjust operation of DI pump 140. Also, controller 170 may send signals to adjust a fuel pressure set-point of a fuel pressure regulator and/or a fuel injection amount and/or timing based on signals from fuel sensor 148, pressure sensor 162, engine speed sensor 164, and the like. Other sensors not shown in FIG. 1 may be positioned around engine 110 and fuel system 150.

The controller 170 can individually actuate each of the injectors 120 via a fuel injection driver 122. The controller 170, the driver 122, and other suitable engine system controllers can comprise a control system. While the driver 122 is shown external to the controller 170, in other examples, the controller 170 can include the driver 122 or the controller can be configured to provide the functionality of the driver 122. The controller 170, in this particular example, includes an electronic control unit comprising one or more of an input/output device 172, a central processing unit (CPU) 174, read-only memory (ROM) 176, random-access memory (RAM) 177, and keep-alive memory (KAM) 178. The storage medium ROM 176 can be programmed with computer readable data representing non-transitory instructions executable by the processor 174 for performing the methods described below as well as other variants that are anticipated but not specifically listed. For example, controller 170 may contain stored instructions for executing various control schemes of DI pump 140 and LP pump 130 based on several measured operating conditions from the aforementioned sensors.

As shown in FIG. 1, direct injection fuel system 150 is a returnless fuel system, and may be a mechanical returnless fuel system (MRFS) or an electronic returnless fuel system (ERFS). In the case of an MRFS, the fuel rail pressure may be controlled via a pressure regulator (pressure relief valve 155) positioned at the fuel tank 152. In an ERFS, a pressure sensor 162 may be mounted at the fuel rail 158 to measure the fuel rail pressure; however, the open loop scheme described herein relegates the pressure sensor 162 to diagnostic purposes only and thus inclusion of the pressure sensor is discretionary. The signal from the pressure sensor 162 may be fed back to the controller 170, which controls the driver 122, the driver 122 modulating the voltage to the DI pump 140 for supplying the correct pressure and fuel flow rate to the injectors.

Although not shown in FIG. 1, in other examples, direct injection fuel system 150 may include a return line whereby excess fuel from the engine is returned via a fuel pressure regulator to the fuel tank via a return line. The fuel pressure regulator may be coupled in-line with the return line to regulate fuel delivered to fuel rail 158 at a set-point pressure. To regulate the fuel pressure at the set-point, the fuel pressure regulator may return excess fuel to fuel tank 152 via the return line upon fuel rail pressure reaching the set-point. It will be appreciated that operation of the fuel pressure regulator may be adjusted to change the fuel pressure set-point to accommodate operating conditions.

FIG. 2 shows DI pump 140 of FIG. 1 in more detail. DI pump 140 intakes fuel from low-pressure passage 154 during an intake stroke and delivers the fuel to the engine via high-pressure passage 156 during a delivery stroke. DI pump 140 includes a compression chamber inlet 203 in fluidic communication with a compression chamber 208 that may be supplied fuel via low pressure fuel pump 130 as shown in FIG. 1. The fuel may be pressurized upon its passage through direct injection fuel pump 140 and supplied to fuel rail 158 (and direct injectors 120) through pump outlet 204. In the depicted example, direct injection pump 140 may be a mechanically-driven displacement pump that includes a pump piston 206 and piston rod 220, a pump compression chamber 208, and a step-room 218. A passage that connects step-room 218 to a pump inlet 299 may include an accumulator 209, wherein the passage allows fuel from the step-room 218 to re-enter the low pressure line surrounding inlet 299. The accumulator 209 may absorb fuel refluxed from the pump chamber 208 back through valve 212. Piston 206 also includes a top 205 and a bottom 207. The step-room 218 and compression chamber 208 may include cavities positioned on opposing sides of the pump piston. In one example, engine controller 170 may be configured to drive the piston 206 in direct injection pump 140 by driving cam 146 via rotation of the engine crankshaft. In one example, cam 146 includes four lobes and completes one rotation for every two engine crankshaft rotations.

DI pump inlet 299 allows fuel to spill valve 212 located along passage 235. Spill valve 212 is in fluidic communication with the low-pressure fuel pump 130 and high-pressure fuel pump 140. Piston 206 reciprocates up and down within compression chamber 208 according to intake and delivery/compression strokes. DI pump 140 is in a delivery/compression stroke when piston 206 is traveling in a direction that reduces the volume of compression chamber 208. Alternatively, DI pump 140 is in an intake/suction stroke when piston 206 is traveling in a direction that increases the volume of compression chamber 208. A forward flow outlet check valve 216 may be coupled downstream of an outlet 204 of the compression chamber 208. Outlet check valve 216 opens to allow fuel to flow from the compression chamber outlet 204 into the fuel rail 158 only when a pressure at the outlet of direct injection fuel pump 140 (e.g., a compression chamber outlet pressure) is higher than the fuel rail pressure. Operation of DI pump 140 may increase the pressure of fuel in compression chamber 208 and upon reaching a pressure set-point, fuel may flow through outlet valve 216 to fuel rail 158. A pressure relief valve 214 may be placed such that the valve limits the pressure in the DI fuel rail 158. Valve 214 may be biased to inhibit fuel from flowing downstream to fuel rail 158 but may allow fuel flow out of the DI fuel rail 158 toward pump outlet 204 when the fuel rail pressure is greater than a predetermined pressure (i.e., pressure setting of valve 214).

The solenoid spill valve 212 may be coupled to compression chamber inlet 203. As presented above, direct injection or high-pressure fuel pumps such as pump 140 may be piston pumps that are controlled to compress a fraction of their full displacement by varying closing timing of the solenoid spill valve. As such, a full range of pumping volume fractions may be provided to the direct injection fuel rail 158 and direct injectors 120 depending on when the spill valve 212 is energized and de-energized. In particular, controller 170 may send a pump signal that may be modulated to adjust the operating state (e.g., open or closed, check valve) of SV 212. Modulation of the pump signal may include adjusting a current level, current ramp rate, a pulse-width, a duty cycle, or another modulation parameter. Mentioned above, controller 170 may be configured to regulate fuel flow through spill valve 212 by energizing or de-energizing the solenoid (based on the solenoid valve configuration) in synchronism with the driving cam 146. Accordingly, solenoid spill valve 212 may be operated in two modes. In a first mode, solenoid spill valve 212 is not energized (deactivated or disabled) to an open position to allow fuel to travel upstream and downstream of a check valve contained in solenoid valve 212. During this mode, pumping of fuel into passage 156 cannot occur as fuel is pumped upstream through de-energized, open spill valve 212 instead of out of outlet check valve 216.

Alternatively, in the second mode, spill valve 212 is energized (activated) by controller 170 to a closed position such that fluidic communication across the valve is disrupted to limit (e.g., inhibit) the amount of fuel traveling upstream through the solenoid spill valve 212. In the second mode, spill valve 212 may act as a check valve which allows fuel to enter chamber 208 upon reaching the set pressure differential across valve 212 but substantially prevents fuel from flowing backward from chamber 208 into passage 235. Depending on the timing of the energizing and de-energizing of the spill valve 212, a given amount of pump displacement is used to push a given fuel volume into the fuel rail 158, thus allowing the spill valve 212 to function as a fuel volume regulator. As such, the timing of the solenoid valve 212 may control the effective pump displacement. Controller 170 of FIG. 1 is included in FIG. 2 for operating solenoid spill valve 212 via connection 184. Furthermore, connection 185 to measure the angular position of cam 146 is shown in FIG. 2. In some control schemes, angular position (i.e., timing) of cam 146 may be used to determine opening and closing timings of spill valve 212.

As such, solenoid spill valve 212 may be configured to regulate the mass (or volume) of fuel compressed into the direct injection fuel pump. In one example, controller 170 may adjust a closing timing of the solenoid spill valve to regulate the mass of fuel compressed. For example, a late spill valve 212 closing may reduce the amount of fuel mass ingested into the compression chamber 208. The solenoid spill valve opening and closing timings may be coordinated with respect to stroke timings of the direct injection fuel pump.

During conditions when direct injection fuel pump operation is not requested, controller 170 may activate and deactivate solenoid spill valve 212 to regulate fuel flow and pressure in compression chamber 208 to a pressure less than the fuel rail pressure during the compression (delivery) stroke. Control of the DI pump 140 in this way may be included in zero flow lubrication (ZFL) methods. During such ZFL operation, on the intake stroke the pressure in compression chamber 208 varies to a pressure near the pressure of the lift pump 130 and just below the fuel rail pressure. Subsequently, the pump pressure rises to a pressure near the fuel rail pressure at the end of the delivery (compression) stroke. If the compression chamber (pump) pressure remains below the fuel rail pressure, zero fuel flow results. When the compression chamber pressure is slightly below the fuel rail pressure, the ZFL operating point has been reached. In other words, the ZFL operating point is the highest compression chamber pressure that results in zero flow rate (i.e., substantially no fuel sent into fuel rail 158). Lubrication of the DI pump's piston-cylinder interface may occur when the pressure in compression chamber 208 exceeds the pressure in step-room 218. This difference in pressures may also contribute to pump lubrication when controller 170 deactivates solenoid spill valve 212. Deactivation of spill valve 212 may also reduce noise produced by valve 212. Said another way, even though the solenoid valve 212 is energized, if the outlet check valve 216 does not open, then the pump 140 may produce less noise than during other operating schemes. One result of this regulation method is that the fuel rail is regulated to a pressure depending on when solenoid spill valve is energized during the delivery stroke. Specifically, the fuel pressure in compression chamber 208 is regulated during the compression (delivery) stroke of direct injection fuel pump 140. Thus, during at least the compression stroke of direct injection fuel pump 140, lubrication is provided to the pump. When the DI pump enters a suction stroke, fuel pressure in the compression chamber may be reduced while still some level of lubrication may be provided as long as the pressure differential remains.

As an example, a zero flow lubrication strategy may be commanded when direct fuel injection is not desired (i.e., requested by the controller 170). When direct injection ceases, pressure in the fuel rail 158 is desired to remain at a near-constant level. As such, the spill valve 212 may be deactivated to the open position to allow fuel to freely enter and exit the pump compression chamber 208 so fuel is not pumped into the fuel rail 158. An always-deactivated spill valve corresponds to a 0% trapping volume, that is, 0 trapped volume or 0 displacement. As such, lubrication and cooling of the DI pump may be reduced while no fuel is being compressed, thereby leading to pump degradation. Therefore, according to ZFL methods, it may be beneficial to energize the spill valve 212 to pump a small amount of fuel when direct injection is not requested. As such, operation of the DI pump 140 may be adjusted to maintain a pressure at the outlet of the DI pump at or below the fuel rail pressure of the direct injection fuel rail, 158 thereby forcing fuel past the piston-bore interface of the DI pump. By maintaining the outlet pressure of the DI pump just below the fuel rail pressure and without allowing fuel to flow out of the outlet of the DI pump into the fuel rail, the DI pump may be kept lubricated, thereby reducing pump degradation. This general operation may be referred to as zero flow lubrication (ZFL).

It is noted here that DI pump 140 of FIG. 2 is presented as an illustrative, simplified example of one possible configuration for a DI pump. Components shown in FIG. 2 may be removed and/or changed while additional components not presently shown may be added to pump 140 while still maintaining the ability to deliver high-pressure fuel to a direct injection fuel rail. In particular, the zero flow lubrication methods described above may be implemented in various configurations of DI pump 140 without adversely affecting normal operation of the pump 140.

Various techniques may be used to control the energy input into the lift fuel pump 130 of FIG. 1, wherein the energy is provided to the pump via connection 182, as described previously. Some of the techniques operate with a lift pump input power level that is higher than a level necessary to prevent vapor formation at the DI pump inlet. In other words, some techniques use excessive lift pump input power in order to provide robust and reliable operation of the lift pump during a range of engine conditions, wherein varying levels of lift pump operation (i.e., varying levels of input power) are desirable. The techniques that use excessive power may undesirably consume extra power that is paid for in additional fuel consumption. As vehicle energy efficiency standards become more stringent, these techniques that use extra power may be undesirable with modern vehicles. Alternatively, other techniques optimize the lift pump power level by reducing power input. These techniques may place a priority on conserving energy over providing a DI inlet pressure that exceeds worst case fuel vapor pressure. However, these techniques that optimize lift pump power, while reducing power consumption, may not reliably provide a DI inlet pressure in excess of vapor pressure for all engine conditions, thereby reducing the reliability of the techniques. Different operating schemes have different advantages and disadvantages. As such, the inventors herein have recognized that a solution is needed that applies minimum lift pump power while robustly providing a fuel pressure in excess of instantaneous fuel vapor pressure. With such a solution, durability of the lift pump may be increased (via operating at a lower average power level) while vapor formation at the inlet of the DI pump is substantially prevented.

The inventors herein have proposed a lift fuel pump control method that involves intermittently providing electrical power to the lift pump according to multiple control modes or schemes. In other words, by providing pulsations of electrical current to the lift fuel pump whenever one or more conditions are met, power may be conserved while at the same time ensuring efficient and reliable pump operation. The pulsations cause the lift pump to produce higher flow rates that may correspond to higher efficiencies compared to continuous operation of the lift pump. Furthermore, the control method may include executing a continuous energy mode when fuel vapor is detected at the inlet of the DI fuel pump, thereby reducing the occurrence of inefficient pump operation with vapor. In some cases, fuel vapor may form when the outlet check valve (valve 104 of FIG. 1) fails or becomes in a stuck open position.

To quantify the energy savings between continuous versus pulsed lift fuel pump operation, FIG. 3 shows a graph 300 of pulsed operation of the lift fuel pump. In the context of the present disclosure, continuous pump operation includes supplying a substantially constant current (i.e., power or energy) to the lift pump. However, when fuel flow demand changes, then the current may be adjusted to a different level, wherein the different level is held substantially constant while the desired fuel flow is provided. Alternatively, pulsed pump operation includes supplying current to the lift pump during a limited time duration. Within this context, the limited time duration may be a threshold such as 0.3 seconds or another suitable quantity depending on the engine and fuel systems. In between pump pulsation events, substantially no current (i.e., none) is provided to the lift pump, thereby ceasing pump operation in between pulsation events.

Turning to FIG. 3, plots 320 and 322 show continuous pump current control. In particular, plot 320 illustrates the change in input current to the lift fuel pumps as a function of time. Plot 322 illustrates the responding pressure changes in the low-pressure fuel passage as a function of time. The pressure changes may at least partially result from changes in the current input to the lift pump. In some examples, the low-pressure fuel passage may be passage 154 located immediately downstream of LP pump 130 in FIG. 1. As labelled in FIG. 3, current is measured in amps while pressure is measured in bar (absolute).

With current provided to the LP pump according to the continuous current mode at plot 320, throughout the period of time depicted in FIG. 3 the current may fluctuate slightly around a desired current level 325. The desired current 325 may depend on the particular pump and other systems. For example, the desired current 325 is 8 amps for some systems. As seen in FIG. 3, the current level of plot 320 continually fluctuates around desired current level 325. The fluctuation may be a result of the feedback system for providing the controller (controller 170 of FIG. 1) with fuel pressure data and other engine operating data. As such, the input current may be slightly adjusted to accommodate for real-time variations in the fuel system. Furthermore, at least partially due to the fluctuation of input current of plot 320, the LP fuel passage pressure of plot 322 also fluctuates. In other words, fuel pressurized by LP pump 130 enters LP passage 154, wherein the fuel may remain at a substantially constant pressure due to the substantially constant pressure provided to the LP pump.

Alternatively, according to the pulsed pump current mode described hereafter, the current may sporadically and temporarily increase for a limited amount of time before returning to another level, such as 0 amps in some examples. As such, the current pulses of the pulsed current mode may be larger than the current fluctuations of plot 320. In between each pulse, substantially no current may be provided to the LP pump. Furthermore, the time in between pulses may change as well as the intensity (i.e., current level) and duration of the pulses. Depending on engine demand and other parameters, these factors and the number of pulses per period of time may change to allow desirable LP pump operation to be maintained according to a pulsed current control scheme. Pulsation events generally result in corresponding increases in the fuel pressure downstream of the LP pump. Furthermore, in between pulsation events when substantially no current provided to the LP pump, the fuel pressure of the LP passage may slightly increase and/or decrease depending on operation of the downstream HP pump 140 as well as loss of fuel from the fuel injectors and other components. It is noted that the shape of the plots of FIG. 3 as well as their relation and dependence on each other are shown for illustrative, explanative purposes. It is understood that variations of the plots of current input and fuel pressure are possible while remaining within the scope of the present disclosure.

Referring to FIG. 3, the current levels of the pulsation events of the pulsed current mode are larger than the near-steady current level of plot 320. In some cases, the pulsation events involve currents exceeding as 10 amps while the continuous current may be only 6 amps. In other words, the pulsation events may utilize transient currents larger than the continuous current. Since the pulsation events are separated by periods where substantially no current is directed to the LP pump, the pulsed mode may consume around the same or less energy than the continuous mode used with the same fuel and engine system. In the current example, the average Pump Electronics Module (PEM) input current of plot 320 with continuous current may be 5.5 amps, which corresponds to an average power consumption of about 75 Watts (W). Furthermore, the average PEM current of the pulsed current mode with pulsed current may be 0.87 amps, which corresponds to an average power consumption of about 12 W. Although the pulsed energy mode utilizes higher currents than those utilized with the continuous energy mode of plot 320, the brief pulses of the pulsed energy mode conserve more energy than the lower, more constant current levels of plot 320.

Since the pulsed lift fuel pump only pumps during the pump's on (or operational) time, the fuel flow rate through the lift pump for the on time may be higher than that of the continuous pump energy approach. As such, the current pulses may create increased flow while the continuous current may create lower fuel flow. It is noted that the average fuel flow rate between the continuous and pulsed pump systems may be similar since the flow rate is determined by engine demand.

The inventors herein have recognized that operating the lift fuel pump according to the aforementioned pulsed control mode may reduce energy consumption while increasing robustness over other control modes such as the continuous current mode. The reduction in energy consumption may be at least partially due to the dependence of pump efficiency on flow rate. FIG. 4 shows a graph 400 depicting how pump efficiency changes as flow rate increases for two different fuel pressures. In particular, fuel flow rate is shown along the horizontal axis while pump efficiency is shown along the vertical axis. Plot 425 illustrates the relation between efficiency and flow rate for a fuel pressure of 3.5 bar (gauge) while plot 435 illustrates the relation for a fuel pressure of 5.2 bar (gauge). As seen, both plots 425 and 435 follow a similar trend, that is, pump efficiency increase and flow rate increases. In the present example of FIG. 4, the lift fuel pump may be a turbine pump that exhibits the behavior shown in graph 400 when the pump is part of a vehicle system in a testing environment. Furthermore, a second general trend is that as fuel pressure provided by the lift pump increases, pump efficiency decreases across all flow rates.

Referring to FIG. 4, during some continuous current modes, the continuous current may correspond to relatively low flow rates, such as 1 cubic centimeter per second (cc/s). As labelled in FIG. 4 as continuous operating point 412, a flow rate of 1 cc/s corresponds to a pump efficiency of about 1% for both pressures of plots 425 and 435. With a pulsed mode, higher flow rates may be produced as a result of the higher currents associated with the pulsed mode. For example, with a pulsed mode fuel flow rate of 25 cc/s, the associated efficiencies of pulsed operating point 414 are about 13% for plot 425 and 12% for plot 435. As seen, the heightened flow rates of the pulsed mode may allow the lift fuel pump to operate with efficiencies at least 10 times as high as the lower efficiencies associated with the continuous mode. The increased efficiencies of the pulsed mode may aid in showing favorability of the pulsed mode over other lift pump operating schemes with regard to optimizing energy consumption and overall energy efficiency of the vehicle. While other specific values for flow rates associated with the pulsed and continuous energy modes may be used besides 25 cc/s and 1 cc/s, respectively, the flow rates of the pulsed mode are generally higher than the flow rates of the continuous mode, and as such, the pump efficiencies associated with the pulsation events are also higher than the efficiencies of the continuous mode.

FIG. 5 shows a graph 500 of an example pulsed current mode for a lift fuel pump. Plot 510 illustrates the level of current being sent to the lift fuel pump. In some embodiments of the pump, this may include sending the current from the controller to a pump electronics module (PEM) that directly operates the lift pump. Plot 520 shows the fuel pressure created by the lift pump as a result of the current input to drive the pump, also known as the pressure of the low-pressure fuel passage. It is noted that the pressure rise due to the current pulse and drop due to fuel consumption is predictable and may not need to be measured, thus saving the expense of a lift pump pressure sensor. In some embodiments, this fuel pressure may be substantially the same as the fuel pressure at an inlet of the direct injection pump (with direct injection fuel systems). Lastly, plot 530 shows a level of fuel consumption measured by a fuel consumption counter. The counter, or other method for determining fuel consumption, may be used as the basis to trigger pulsation events. Time is represented as the horizontal axis for all plots shown in FIG. 5. Times t1 and t2, as explained in further detail below, may also be referred to as current pulsation events.

Referring to FIG. 5, prior to time t1 pump input current may be maintained at a substantially constant level, such as 0 amps to conserve energy. As such, as fuel in the low-pressure fuel passage is pumped into the fuel rail (and then sent to the direct injectors and combusted by the engine), the pressure in the LP passage decreases. Related, during this time, the fuel consumption counter exhibits a decreasing amount of fuel present. A threshold fuel level 532 can be seen in plot 530, wherein the threshold level is representative of the amount of consumed fuel at which a current pulsation event is triggered (i.e., commanded or desired). In other words, threshold fuel level 532 is a counter threshold that is preset to a desired amount of consumed fuel. In the present example, the desired fuel consumption is 3 cubic centimeters (cc). Horizontal line 533 represents 0 cc of fuel, which may be the level reached by the counter when a pulsation event is triggered. In other words, plot 530 illustrates a count-down variable. When the fuel volume counts down from 3 cc to 0 cc, the lift pump is re-energized for a short pulse. In summary, lift pump is energized for a short duration every time a given fuel volume is pumped into the fuel rail (or alternatively a given fuel volume is injected into the engine).

At time t1, when the fuel consumption counter of plot 530 decreases to 0 cc from the preset threshold 532 (3 cc in this case), then a pulsation event is triggered. In some examples, the triggering may involve sending a signal from the fuel consumption counter and associated sensors to controller 170 of FIG. 1, whereupon the controller sends an electrical signal (i.e., a current) to the lift pump. As such, the input current to the lift fuel pump of plot 510 may increase shortly after threshold 532 is reached, or close to time t1. In response to the input current, the lift pump may operate in order to provide fuel under pressure to the low-pressure fuel passage. The increase in the pressure in the LP fuel passage or lift fuel pump pressure, is seen in plot 520. After completion of a preset time duration, the input current to the lift pump may decrease back to substantially 0. The preset time duration may be a value such as 200 milliseconds in some examples. Also, the time duration may be calculated and recorded by a counter program coded into controller 170 or another suitable device. The preset time duration quantifies the length of the each pulsation event.

Between times t1 and t2, when substantially no current is sent to the lift pump, the lift pump pressure steadily decreases as fuel is sent through the DI pump and injected into the engine. Furthermore, the fuel consumption counter reactivates and begins measuring the volume of fuel consumed by the engine. Regarding FIG. 5, the data shown represents the case of constant fuel consumption and constant fuel rail pressure. As such, a steady, linear decrease can be seen in plot 530. In other words, fuel consumption corresponds to a decrease in plot 530 whereas resetting the counter corresponds to vertical increases in plot 530.

At time t3, again when the fuel consumption counter of plot 530 reaches the preset threshold 532, another current pulsation event is triggered. Upon triggering the event, the controller 170 sends the appropriate level of current to the lift fuel pump, whereupon the input current of plot 510 rapidly increases. In response to the increase in current that enables the lift pump to produce flow and pressure in the fuel, the pressure of the lift pump (and pressure at the inlet of the DI pump) also increases as seen in plot 520, similar to the increase shown at time t1. Upon expiration of the preset time duration (200 milliseconds), the input current decreases to the initial value such as 0. As such, after time t2 and reduction of the current, the lift pump pressure decreases in a generally linear fashion as fuel is sent into the DI pump. Furthermore, the fuel consumption counter resets at time t2 and starts decreasing as fuel is consumed by the engine. The processes prior to, at, and after times t1 and t2 may be repeated during operation of the vehicle.

As seen in the two pulsation events of times t1 and t2 of FIG. 5, fluctuations in the input current may occur as a normal result of noise present in the electrical system between the controller and its connected systems. Furthermore, as a result of the fluctuations in current, the lift fuel pump pressure may also fluctuate before steadily decreasing after the input current is shut off. It is noted that graph 500 is presented as an example visualization of the present lift pump pulsation control scheme. As such, other examples of similar pulsation control schemes may include different shapes of plots 510, and 520, and 530. For example, the time duration may be longer such that the lift pump pressure increases to a higher level than shown in FIG. 5.

The minimum DI inlet pressure may be governed primarily by fuel temperature. Higher fuel temperatures may require higher minimum DI inlet pressure. In an example operating mode, a single minimum DI inlet pressure is selected. However, a further optimization may be obtained by varying the minimum DI inlet pressure. For example, if the minimum DI inlet pressure was selected as 3 bar, the DI inlet pressure would vary between 3 and 6.4 bar. This could be accomplished by choosing a different fuel volume between pulses and also choosing a different pulse duration. As the minimum pressure is lower, the volume interval between pulses can be extended but the pulse duration could be slightly increased.

Other control schemes such as the continuous lift pump mode may control a computed, variable target pressure for the DI pump inlet and may vary the fuel pressure via pulsing the pump by utilizing data from pressure sensor feedback. The pulsed pump approach, alternatively, may allow the pressure to vary but enforce a minimum DI pump inlet pressure which may optionally be computed and variable. As such, the variable pressure may be attained reliably without the use of low pressure sensor feedback.

FIG. 6 shows another example of a graph 600 of a pulsed current mode for a lift fuel pump. The lift fuel pump pressure is shown at plot 660, wherein the horizontals axis is fuel volume while the vertical axis is pressure of the lift fuel pump. The value of slope 622 (i.e., the steepness) may at least partially depend on the compliance of the low-pressure fuel passage located in between the LP and DI pumps, as described with regard to FIG. 1. The compliance of the passage may maintain pressure on the fuel located inside the passage as the fuel is being pumped through the DI pump and consumed by the engine. In particular, the slope 622 may represent a measure of the compliance of the system. For example, the value of slope 622 (compliance) may be 0.6 bar/cc of fuel. Again, the threshold amount of fuel consumed to trigger the pulsation events of times t1 and t2 may be 3.0 cc.

FIG. 7 shows flow chart of a method 700 for operating the lift fuel pump. In particular, method 700 includes operating the lift fuel pump in the aforementioned pulsed pump current mode, which may also be equivalently referred to as the pulsed energy mode. First, at 701, the method includes determining a number of engine operating conditions. These conditions may vary depending on the engine and fuel system configurations, and may include, but are not limited to, engine speed, fuel composition and temperature, engine fuel demand, driver demanded torque, a preset time duration, a threshold fuel consumption volume, a and engine temperature. Next, at 402, the method includes inputting parameters to the controller. The parameters may include data gathered from one or more sensors positioned throughout the engine system. In particular, pressure and other data from the LP and DI pumps as well as the LP passage connecting the two pumps may be sent to controller for aiding in the following steps of method 700. A fuel consumption counter can be activated at 703, wherein the counter measures a volume of fuel consumed by the engine (combusted in the cylinders) via one or more sensors. In some examples, the counter begins from an initial value such as 0, then tracks fuel consumption until the threshold fuel consumption volume is reached, as explained below. It is noted that during the initial steps 701, 702, and 703, the LP pump is in a turned off state such that substantially no current is provided to the pump from the controller or any other energy source.

At 704, the method includes calculating if the current fuel consumption volume is greater than the threshold fuel consumption volume. If the current volume is less than the threshold volume, then the method returns to 704 and repeats the calculation. Alternatively, if the fuel consumption is greater than the threshold volume, then the method continues to 705. In one example, the threshold volume is 3 cc. At 705, the control scheme includes sending the pulsed current for the preset time duration from the controller to the lift fuel pump. In other words, the current is sent to energize (i.e., activate) the LP pump such that the pump operates for the preset time duration, which may be 200 milliseconds in some examples. As a result of the pulsed current signal, the LP pump may pressurize fuel in the LP fuel passage before the fuel is sent into the DI pump. Finally, at 706, the method includes resetting the fuel consumption counter to the initial value, such as 0. In this way, method 700 may be repeated to determine when the threshold consumed fuel volume has again been reached to activate the LP pump.

If full vehicle voltage is applied to the lift pump, a high peak current may result. As such, if the high peak current is determined to be undesirable, the peak lift pump current (or PEM current) can be reduced via limiting the rate of voltage application during the pulsed energy mode. For example, during this situation, applying 8 volts for 50 milliseconds, then 10 volts for 50 milliseconds, and then 12 volts for 100 milliseconds may be an effective way to limit peak current to be approximately equal to a steady-state current.

The pulsed pump current mode may be operated without the use of a lift pump pressure sensor and without a vapor detection algorithm. In some fuel systems, the pressure sensor may be placed at the outlet of the LP pump while the vapor detection algorithm is used to determine when fuel vaporizes in between the LP and DI pumps. As such, the pulsed current method, as described above, may be executed with open loop control processes. Alternatively, the pressure sensor and vapor detection algorithm may be used with the pulsed current method to provide feedback and diagnostics to the system. Furthermore, the energy (current) pulses sent to the LP pump may be shaped to reduce maximum PEM or motor current in situations where durability of the PEM or motor is better preserved. The preset time duration and fuel consumption volume threshold can be adjusted during engine and fuel system operation. For example, the fuel volume can be decreased if the fuel temperature or fuel volatility increases. As a result, the minimum lift fuel pump pressure (i.e., minimum DI pump inlet pressure) increases. In some embodiments, to add to the robustness of the pulse energy mode, current pulses may also be sent to the LP pump when threshold decreases in LP pump effectiveness or efficiency are detected.

In this way, by pulsing the lift pump when an amount of fuel is consumed, more electrical energy may be saved compared to running the lift pump continuously. However, the inventors herein have recognized that malfunction of the lift pump check valve may impact proper operation during the pulsed energy mode. In particular, when the check valve, such as valve 104 of FIG. 1 is stuck in an open position, an algorithm is needed to detect the malfunction and mitigate the malfunction accordingly.

In fuel systems that includes a pressure sensor located in low-pressure passage 154 of FIG. 1, failure of the check valve 104 may be detected in the following way. When the check valve fails (becomes stuck in the open position), the pressure of the LP passage may immediately decrease to the vapor pressure of the fuel or other pumped liquid. As such, when a pressure sensor is in place, the sudden drop in pressure can be detected by the pressure sensor. To mitigate this issue, the aforementioned pulsed energy mode may be discontinued and another operating mode activated. The other operating mode may be a continuous energy mode, wherein a substantially constant current is provided to the LP pump, as described previously. Furthermore, the continuous energy mode may involve either open or closed loop control. With open loop control, in some examples, LP pump parameters such as input power, voltage, current, torque, and speed are scheduled. Alternatively, with a closed loop control, the parameters may at least partially depend on feedback from one or more sensors and/or controller programs.

In fuel systems that do not include a pressure sensor located in low-pressure passage 154 of FIG. 1, additional pulsation events may be commanded in addition to those regularly scheduled in response to the threshold fuel consumption volume. With this method, vapor at the inlet of the DI pump may be assumed to be caused by a check valve failure (stuck open valve). In other words, during the pulsed current mode when the pump is being pulsed for 200 milliseconds every time 3 cc of fuel is consumed, for example, the pump is also pulsed when a vapor formation event is detected. FIG. 8 shows several graphs 800 depicting operation of the lift fuel pump during different situations. Graph 810 shows normal operation of the lift fuel pump during the pulsed energy mode while graph 820 also shows normal operation but in a different way than that shown in 810. Graph 830, alternatively, shows operation of the lift fuel pump when a faulty check valve is detected. It is noted that that instead of commanding lift pump pulses that are triggered at 3 cc fuel consumption intervals, the lift pump pulses may occur more often and thus may be triggered by detection of vapor and not the fuel volume counter. This example indicates that the lift pump's outlet check valve may be leaking The check valve may only function when the lift pump is providing low or no fuel pressure. As such, turning off the lift pump, as commanded by the pulsed lift pump scheme, allows the outlet check valve to remain functional. The horizontal axis for the three graphs is shown as fuel volume consumed, measured in cubic centimeters. The vertical axis for the three graphs is shown as pressure in the low-pressure fuel passage, measured in bar (absolute). Each of the three graphs includes vertical sections connected with sloped lines. With graphs 810 and 820, each vertical section is aligned with consumed fuel volumes that are divisible by 3, with the exception of 0 cc, the initial consumed volume. With the pulsed energy modes associated with graphs 810 and 820, the threshold fuel consumed volume is 3 cc. As such, when 3 cc of fuel is consumed, current is pulsed to the LP pump, thereby increasing the fuel pressure downstream of the pump, resulting in the vertical segments of the graphs. Once the pulse ceases, pressure in the LP fuel passage decreases as shown until another 3 cc of fuel is consumed. It is appreciated that other values besides 3 cc may be used for the threshold fuel consumed volume.

It is noted that as the minimum desired pressure drops that the pressure can range lower. A 0.6 bar per cc compliance may be a fixed constant of the given fuel system design. If the fuel pressure decreases but the maximum pressure is held constant, then the volume grows (i.e., larger than 3 cc). For example, if the fuel pressure decreases an additional 0.6 bar, the volume needs to be increased by 1 cc.

Referring to graph 810, an inferred vapor pressure 815 is labelled, corresponding to a pressure of 4 bar. The inferred vapor pressure 815 may be an estimate based on a variety of parameters, including fuel composition, temperature, volume, flow rate, etc. As it may be desirable to operate the lift pump above the inferred vapor pressure, curve 810 representing the pulsation events of the pulsed energy mode is located above the inferred pressure 815. In this way, while performing normal operation in the pulsed energy mode, the LP fuel passage pressure is maintained above the vapor pressure (4 bar in the present example). Similarly, graph 820 shows normal operation of the lift pump during the pulsed energy mode, but the inferred vapor pressure 825 is different than the inferred vapor pressure 815 of graph 810. In particular, inferred vapor pressure 825 is 3 bar (instead of 4 bar), as seen by the vertical axis labels. As such, the pressure range of graph 820 is lower than the pressure range of graph 810. The pressure range of graph 810 appears to be between about 5 bar and 7 bar, whereas the pressure range of graph 820 appears to be between about 4 bar and 7 bar. In this way, when the inferred vapor pressure is lower, the pulsed energy mode may be implemented such that the range of pressure of the lift pump is higher in order to operate the lift pump above the inferred vapor pressure.

Referring to graph 830, mitigating operation of the lift pump is shown, wherein vapor formation at the inlet of the DI pump or in the LP fuel passage is likely occurring. Compared to graphs 810 and 820 wherein the curves do not intersect the inferred vapor pressure, graph 830 intersects with a line defined as the actual vapor pressure 835. The actual vapor pressure is about 2 bar in the current example. A leftmost portion of graph 830 is referred to as pulsed section 837, wherein the LP pump is pulsed to increase the fuel pressure in order to decrease the formation of fuel vapor. While pulsed section 837 appears similar in shape to graphs 810 and 820, the function of each are different. While graphs 810 and 820 are a result of normal operation of the LP pump according to the pulsed energy mode, graph 830 (and pulsed section 837) is a result of an operating mode that attempts to mitigate vapor formation in the LP fuel passage. Instead of pulsing the pump according to a schedule such as 3 cc (as with graphs 810 and 820), pulsed section 837 sends current pulses to the LP pump to increase fuel pressure above the vapor pressure shown by line 835. Furthermore, the intervals in between subsequent pulsation events are shortened in graph 830 as compared to the intervals of graphs 810 and 820. In addition, the length of pulsation events of graph 830 may be longer than those of graphs 810 and 820, as seen by the horizontal segments in pulsed section 837. It is noted that a minimum DI pump inlet pressure that exceeds the current fuel vapor pressure may be selected by the controller or other suitable device.

Upon completion of a condition such as a volume of fuel consumed while performing the pulsed mitigating action of section 837, a time duration, or a number of pulsation events, operation of the LP pump may switch from the pulsed energy mode to the continuous energy mode, as indicated at transition 838. In another example, the condition may include concluding that the vapor formation is caused by failure of the check valve, when it is stuck in the open position. When transition 838 occurs, a continuous current may be directed to the LP pump during the continuous energy mode as seen through section 839. The continuous energy section maintains a smaller fuel pressure range than the pressure range of pulsed section 837. In particular, the fuel pressure range of pulsed section 837 appears to be about 2 bar to 7 bar, whereas the fuel pressure range of continuous section 839 appears to be about 5.5 bar to 6.5 bar. The elevated pressure of continuous section 839 may reduce vapor formation as well as mitigate the faulty check valve.

In this way, by selectively operating the low-pressure fuel pump (lift pump) via pulsed or continuous energy modes, energy consumption may be optimized while providing robust operation of the lift pump. Different combinations of the pulsed and continuous energy modes may be used to alter operation of the lift pump according to different operating conditions. For example, the pulsed energy mode may be implemented throughout all operating conditions of the lift pump, and further does not include a pressure sensor. In another example, both pulsed and continuous energy modes may be implemented with the use of a pressure sensor for detecting vapor formation to trigger switching between the two modes. Other examples are possible while remaining within the scope of the present disclosure. Furthermore, vapor formation caused by check valve failure may be detected and mitigated while using the pulsed energy mode or a combination of the pulse and continuous energy modes. During the pulsed energy mode, parameters such as the threshold consumed fuel volume and the preset pulse time duration may be continuously adjusted to adapt to changing engine and fuel system demand. This may achieve the technical effect of providing effective lift pump operation during a variety of engine conditions while optimizing (i.e., reducing) energy consumption.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method of operating a lift fuel pump, comprising:

operating the lift fuel pump in a pulsed energy mode for a discrete time duration only upon detection of a fuel volume greater than a threshold being expelled by a direct-injection fuel pump positioned downstream of the lift fuel pump; and switching operation of the lift fuel pump to a continuous energy mode when vapor pressure is detected at an inlet of the direct-injection fuel pump.

2. The method of claim 1, wherein the pulsed energy mode includes sending a series of discrete electrical signals to a power input of the lift fuel pump to initiate operation of the lift fuel pump, and where the power input of the lift pump is at a minimum value between the discrete electrical signals.

3. The method of claim 1, wherein the continuous energy mode includes sending a substantially continuous electrical signal to a power input of the lift fuel pump to initiate operation of the lift fuel pump, and wherein the pulsed energy mode includes sending a series of discrete electrical signals to the power input, the discrete electrical signals comprising a variable voltage.

4. The method of claim 2, wherein the discrete time duration is 200 milliseconds and the threshold fuel volume is 3 cubic centimeters, and wherein the minimum value is zero.

5. The method of claim 1, wherein detecting the vapor pressure is performed via a pressure sensor located in a low-pressure fuel passage connecting the lift fuel pump to the direct-injection fuel pump.

6. The method of claim 1, wherein detecting the vapor pressure is performed via timing energy pulsation events and the time in between events.

7. The method of claim 1, wherein the lift fuel pump is an electrically-powered pump that pressurizes fuel to a lower pressure than a pressure of fuel pumped by the direct-injection pump that is a mechanically-operated, positive-displacement pump.

8. A method of operating a lift fuel pump, comprising:

activating the lift fuel pump for a discrete time duration only upon detection of discharging of a volume of fuel greater than a threshold from one or more direct injectors, wherein the discrete time duration is based on a desired increase in pressure provided by the lift fuel pump, wherein activating the lift fuel pump includes sending one or more electrical signals from a controller to the lift fuel pump to pressurize fuel in a fuel passage which communicates with a direct-injection pump.

9. The method of claim 8, wherein activating the lift fuel pump includes sending a series of discrete electrical signals to the lift fuel pump, and where a power input of the lift fuel pump is at a minimum value between the discrete electrical signals.

10. The method of claim 9, wherein the discrete time duration is 200 milliseconds and the threshold volume of fuel is 3 cubic centimeters and wherein the minimum value is zero.

11. The method of claim 8, further comprising upon detection of fuel vapor at an outlet of the lift fuel pump, providing a continuous current to the lift fuel pump to activate it for an extended time duration longer than the discrete time duration.

12. The method of claim 8, wherein a pressure sensor located downstream of the lift fuel pump measures fuel pressure provided by the lift fuel pump to provide feedback to control the lift fuel pump.

13. The method of claim 9, wherein activating the lift fuel pump for the discrete time duration includes controlling the lift fuel pump in an open-loop control, and further comprising, upon detection of fuel vapor at an outlet of the lift fuel pump, sending additional discrete electrical signals to the lift fuel pump.

14. The method of claim 13, wherein the open-loop control includes providing no feedback to control the lift fuel pump, the feedback including fuel pressure readings from a pressure sensor located at an outlet of the lift fuel pump and an algorithm for detecting fuel vapor downstream of the lift fuel pump.

15. A system, comprising:

a lift fuel pump providing fuel to a fuel line;

a direct-injection fuel pump fluidically coupled to the fuel line downstream of the lift fuel pump, the direct-injection fuel pump pressurizing the fuel into a fuel rail including one or more direct injectors; and a controller with computer-readable instructions stored in non-transitory memory for:

operating the lift fuel pump in a pulsed energy mode and switching operation of the lift fuel pump to a continuous energy mode when vapor pressure is detected at an inlet of the direct-injection fuel pump.

16. The system of claim 15, wherein the direct-injection fuel pump pressurizes fuel to a higher pressure than a pressure provided by the lift fuel pump.

17. The system of claim 15, wherein the controller further comprises computer-readable instructions for controlling operation of the direct-injection fuel pump.

18. The system of claim 15, wherein a pressure sensor is located in the fuel line positioned between the lift fuel pump and the direct-injection fuel pump.

19. The system of claim 15, wherein the pulsed energy mode includes sending a series of discrete electrical signals to a power input of the lift fuel pump to initiate operation of the lift fuel pump, and where the power input of the lift fuel pump is at a minimum value between the discrete electrical signals.

20. The system of claim 15, wherein the continuous energy mode includes sending a substantially continuous electrical signal to a power input of the lift fuel pump to initiate operation of the lift fuel pump, and wherein the pulsed energy mode includes sending a series of discrete electrical signals to the power input, the discrete electrical signals comprising a variable voltage.

* * * * *